US007318412B2

(12) United States Patent
Ito et al.

(10) Patent No.: US 7,318,412 B2
(45) Date of Patent: Jan. 15, 2008

(54) CONTROL DEVICE FOR INTERNAL COMBUSTION ENGINE

(75) Inventors: Yukikazu Ito, Nishikamo-gun (JP); Kenichi Kinose, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 52 days.

(21) Appl. No.: 11/339,776

(22) Filed: Jan. 26, 2006

(65) Prior Publication Data

US 2006/0207557 A1 Sep. 21, 2006

(30) Foreign Application Priority Data

Mar. 18, 2005 (JP) ..... 2005-078292

(51) Int. Cl.
*F02D 41/14* (2006.01)

(52) U.S. Cl. ..... 123/431; 123/685; 123/686

(58) Field of Classification Search ..... 123/431, 123/685, 686, 575, 576
See application file for complete search history.

(56) References Cited

U.S. PATENT DOCUMENTS 4,535,736 A * 8/1985 Taura et al. ..... 123/391
5,197,450 A * 3/1993 Kitajima et al. ..... 123/685
5,482,023 A 1/1996 Hunt et al.
5,598,826 A 2/1997 Hunt et al.
6,557,521 B2 5/2003 Ichihara et al.
6,606,976 B2 8/2003 Nagano et al.
7,159,568 B1 * 1/2007 Lewis et al. ..... 123/431
2002/0134362 A1 * 9/2002 Deutsch ..... 123/575
2005/0268891 A1 12/2005 Nagano et al.

FOREIGN PATENT DOCUMENTS

EP 1 138 901 A2 10/2001
EP 1 223 327 A2 7/2002
JP 03-185242 A 8/1991
JP 04-241756 A 8/1992
JP 2000-227041 A 8/2000

* cited by examiner

*Primary Examiner*—Erick Solis
(74) *Attorney, Agent, or Firm*—Oliff & Berridge, PLC

(57) ABSTRACT

An engine ECU executes a program including the steps of: starting an engine by transiently increasing an amount of fuel injection when a start request is detected; prohibiting calculation of a learn value when a condition for stopping transient increase is not satisfied; stopping transient increase when the condition for stopping transient increase is satisfied; steadily increasing the amount of fuel injection in accordance with a coolant temperature TW; and permitting calculation of a learn value during steady increase in accordance with the coolant temperature TW.

16 Claims, 8 Drawing Sheets

CONTROL DEVICE FOR INTERNAL COMBUSTION ENGINE

This nonprovisional application is based on Japanese Patent Application No. 2005-078292 filed with the Japan Patent Office on Mar. 18, 2005, the entire contents of which are hereby incorporated by reference.

BACKGROUND OF THE INVENTION

1. Field of the Invention

The present invention relates to a control device for an internal combustion engine that includes a first fuel injection mechanism (in-cylinder injector) injecting fuel into a cylinder and a second fuel injection mechanism (intake manifold injector) injecting fuel into an intake manifold or an intake port, and more particularly to a technique to correct an amount of fuel injection from the first fuel injection mechanism and the second fuel injection mechanism.

2. Description of the Background Art

An internal combustion engine provided with an intake manifold injector for injecting fuel into an intake manifold and an in-cylinder injector for constantly injecting fuel into a combustion chamber, in which fuel injection from the intake manifold injector is stopped when load of the engine is lower than preset load and fuel injection from the intake manifold injector is allowed when load of the engine is higher than the preset load, is known.

Even in such an internal combustion engine, a desired amount of fuel injection may not be attained due to deposits accumulated in the injector or difference between individual engines caused during manufacturing. Namely, an air-fuel ratio may deviate from a desired air-fuel ratio (for example, stoichiometric air-fuel ratio). In order to correct such deviation in the amount of fuel injection, the amount of fuel injection is corrected by feedback control of the air-fuel ratio, as in an internal combustion engine including one injector for each cylinder.

Japanese Patent Laying-Open No. 03-185242 discloses a fuel injection amount control device for an internal combustion engine that accurately corrects an amount of fuel injection in the internal combustion engine including a plurality of fuel injection valves for each cylinder. The fuel injection amount control device includes a control unit controlling fuel injection from the plurality of fuel injection valves in accordance with an operation state, a learning unit learning a value based on an output signal from an oxygen sensor provided in an exhaust system of the engine so as to correct the amount of fuel injection, a setting unit setting a plurality of learning regions corresponding to states of use of the plurality of fuel injection valves, and a correction unit using each learn value learned in the learning region to correct the amount of fuel injection in the operation state corresponding to each learning region.

According to the fuel injection amount control device described in this publication, as the fuel injection valve used in the learning region is the same as that used in correcting the amount of fuel injection with the learn value, accuracy in correcting the amount of fuel injection is improved. Therefore, follow-up characteristic of the air-fuel ratio is enhanced and exhaust emission is improved. In addition, as deviation from a target air-fuel ratio becomes small, possibility of misfire is suppressed and fuel efficiency can be improved even if a leaner air-fuel ratio is set.

Meanwhile, in the internal combustion engine, for example at the time of cold start, the amount of fuel injection may be increased in order to improve starting capability.

When the amount of fuel injection is increased like this, the air-fuel ratio may necessarily vary, as compared with a case in which the amount of fuel injection is not increased. The fuel injection amount control device according to Japanese Patent Laying-Open No. 03-185242, however, does not take into consideration such a case in which the amount of fuel injection is increased. Therefore, the amount of fuel injection may unnecessarily be corrected as a result of learning of the learn value, and correction of the amount of fuel injection based on the learn value may be inappropriate.

SUMMARY OF THE INVENTION

An object of the present invention is to provide a control device for an internal combustion engine capable of appropriately correcting an amount of fuel injection.

A control device for an internal combustion engine according to the present invention controls an internal combustion engine including a first fuel injection mechanism injecting fuel into a cylinder and a second fuel injection mechanism injecting fuel into an intake manifold. The control device includes: a first control unit controlling the fuel injection mechanism so that the fuel is injected solely from any one of the first fuel injection mechanism and the second fuel injection mechanism at least during cranking and idling in which a temperature of the internal combustion engine is equal to or lower than a predetermined value; a second control unit controlling the fuel injection mechanism so that the fuel is injected from the first fuel injection mechanism and the second fuel injection mechanism; a calculation unit calculating a correction value for an amount of fuel injection based on an air-fuel ratio; a prohibition unit prohibiting calculation of a correction value for an amount of fuel injection at least during a period from start of cranking of the internal combustion engine to full combustion thereof; and a permission unit permitting calculation of a correction value for an amount of fuel injection during a predetermined period after full combustion of the internal combustion engine.

According to the present invention, the first control unit controls the fuel injection mechanism so that the fuel is injected solely from any one of the first fuel injection mechanism and the second fuel injection mechanism at least during cranking and idling in which the temperature of the internal combustion engine is equal to or lower than the predetermined value. The second control unit controls the fuel injection mechanism so that the fuel is injected from the first fuel injection mechanism and the second fuel injection mechanism. In the internal combustion engine in which the fuel injection mechanism is controlled in such a manner, it is not always the case that there are many occasions in which the fuel is injected solely from any one of the first fuel injection mechanism and the second fuel injection mechanism. Accordingly, it is not always the case that there are many occasions to calculate the correction value for the amount of fuel injection while the fuel is injected solely from any one of the first fuel injection mechanism and the second fuel injection mechanism. Therefore, in a state in which the fuel is injected solely from any one of the first fuel injection mechanism and the second fuel injection mechanism, the correction value for the amount of fuel injection should be calculated as many times as possible. Hence, the correction value may be calculated also during a cold state of the internal combustion engine in which the fuel may be injected solely from any one of the first fuel injection mechanism and the second fuel injection mechanism (including cranking and idling in which the temperature of the internal combustion engine is not higher than the predetermined value). At the time of start in the cold state of the internal combustion engine, at least during a period from the start of cranking to full combustion, the amount of fuel injection may transiently be corrected (increased). Meanwhile, during a predetermined period after full combustion, the amount of fuel injection may steadily be corrected (increased) in accordance with the temperature of the internal combustion engine. While the injection amount is transiently increased, the air-fuel ratio may suddenly change. On the other hand, while the injection amount is steadily increased, the air-fuel ratio is stable. Accordingly, at least during the period from the start of cranking to full combustion, calculation of the correction value for the amount of fuel injection is prohibited, and during the predetermined period after full combustion, calculation of the correction value for the amount of fuel injection is permitted. Therefore, the correction value for the amount of fuel injection can be calculated while the air-fuel ratio is stable, and miscalculation of the correction value can be suppressed. Consequently, a control device for an internal combustion engine capable of appropriately correcting an amount of fuel injection can be provided.

Preferably, the first control unit controls the fuel injection mechanism so that the fuel is injected solely from the second fuel injection mechanism during cranking and idling in which the temperature of the internal combustion engine is equal to or lower than the predetermined value.

According to the present invention, the fuel injection mechanism is controlled so that the fuel is injected solely from the second fuel injection mechanism during cranking and idling in which the temperature of the internal combustion engine is equal to or lower than the predetermined value. In the internal combustion engine in which the fuel injection mechanism is controlled in such a manner, it is not always the case that there are many occasions in which the fuel is injected solely from the second fuel injection mechanism. Accordingly, it is not always the case that there are many occasions to calculate the correction value for the amount of fuel injection while the fuel is injected solely from the second fuel injection mechanism. Therefore, in a state in which the fuel is injected solely from the second fuel injection mechanism, the correction value for the amount of fuel injection should be calculated as many times as possible. Hence, the correction value may be calculated also during a cold state of the internal combustion engine in which the fuel may be injected solely from the second fuel injection mechanism (including cranking and idling in which the temperature of the internal combustion engine is not higher than the predetermined value). At the time of start in the cold state of the internal combustion engine, at least during a period from the start of cranking to full combustion, the amount of fuel injection may transiently be corrected (increased). Meanwhile, during a predetermined period after full combustion, the amount of fuel injection may steadily be corrected (increased) in accordance with the temperature of the internal combustion engine. While the injection amount is transiently increased, the air-fuel ratio may suddenly change. On the other hand, while the injection amount is steadily increased, the air-fuel ratio is stable. Accordingly, at least during the period from the start of cranking to full combustion, calculation of the correction value for the amount of fuel injection is prohibited, and during the predetermined period after full combustion, calculation of the correction value for the amount of fuel injection is permitted. Therefore, the correction value for the amount of fuel injection can be calculated while the air-fuel ratio is stable, and miscalculation of the correction value can be suppressed.

Preferably, the predetermined period is a period during which the amount of fuel injection is corrected based on the temperature of the internal combustion engine.

According to the present invention, the air-fuel ratio is stable while the amount of fuel injection is steadily corrected in accordance with the temperature of the internal combustion engine. During such a period, calculation of the correction value for the amount of fuel injection is permitted. Therefore, the correction value for the amount of fuel injection can be calculated while the air-fuel ratio is stable, and miscalculation of the correction value can be suppressed.

Preferably, the control device further includes a correction prohibition unit prohibiting correction of the amount of fuel injection based on the correction value calculated when the amount of fuel injection is corrected based on a factor other than the temperature and the air-fuel ratio of the internal combustion engine.

According to the present invention, correction of the amount of fuel injection based on the correction value calculated when the amount of fuel injection is corrected based on a factor other than the temperature and the air-fuel ratio of the internal combustion engine (such as fuel adhered to a wall surface of an intake port or fuel purged from a canister) is prohibited. Accordingly, unnecessary correction of the amount of fuel injection with the correction value calculated when the amount of fuel injection is transiently corrected based on the fuel adhered to the wall surface of the intake port or the fuel purged from the canister can be suppressed. Therefore, the amount of fuel injection can appropriately be corrected.

Preferably, the first fuel injection mechanism is an in-cylinder injector, and the second fuel injection mechanism is an intake manifold injector.

According to the present invention, in the internal combustion engine in which the in-cylinder injector serving as the first fuel injection mechanism and the intake manifold injector serving as the second fuel injection mechanism are separately provided to inject the fuel at a ratio set therebetween, the amount of fuel injection can appropriately be corrected.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
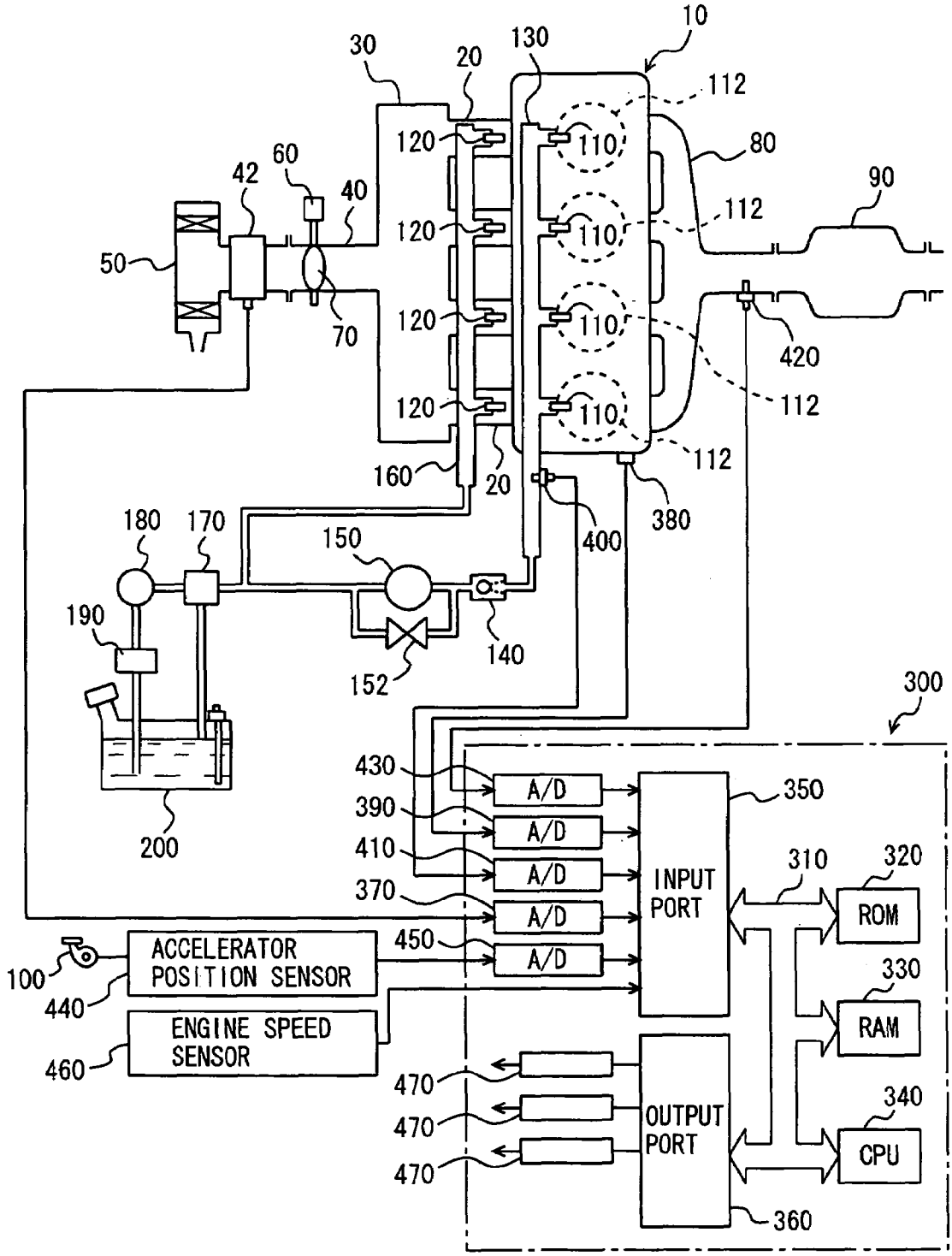
FIG. 1 is a schematic configuration diagram of an engine system controlled by a control device according to a first embodiment of the present invention.

An embodiment of the present invention will be described hereinafter with reference to the drawings. The same elements have the same reference characters allotted. Their label and function are also identical. Therefore, detailed description thereof will not be repeated.

First Embodiment

FIG. 1 schematically shows a configuration of an engine system controlled by an engine ECU (Electronic Control Unit) that is a control device of an internal combustion engine according to a first embodiment of the present invention. Although an in-line 4-cylinder gasoline engine is shown in FIG. 1, application of the present invention is not restricted to the engine shown, and the present invention is applicable to various types of engines such as a V-type 6-cylinder engine, a V-type 8-cylinder engine and the like.

As shown in FIG. 1, an engine 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its opening position controlled based on an output signal of an engine ECU 300, independently of an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake port and/or an intake manifold are provided. These injectors 110, 120 are controlled based on output signals of engine ECU 300. In-cylinder injectors 110 are connected to a common fuel delivery pipe 130. Fuel delivery pipe 130 is connected to a high-pressure fuel pump 150 of an engine driven type via a check valve 140 that allows flow toward fuel delivery pipe 130. In the present embodiment, description will be made as to the internal combustion engine having two injectors provided separately, although the present invention is not limited thereto. For example, the internal combustion engine may have a single injector capable of performing both in-cylinder injection and intake manifold injection.

As shown in FIG. 1, the discharge side of high-pressure fuel pump 150 is connected to the intake side of high-pressure fuel pump 150 via an electromagnetic spill valve 152. It is configured such that the amount of the fuel supplied from high-pressure fuel pump 150 to fuel delivery pipe 130 increases as the degree of opening of electromagnetic spill valve 152 is smaller, and that fuel supply from high-pressure fuel pump 150 to fuel delivery pipe 130 is stopped when electromagnetic spill valve 152 is fully opened. Electromagnetic spill valve 152 is controlled based on an output signal of engine ECU 300.

Meanwhile, intake manifold injectors 120 are connected to a common fuel delivery pipe 160 on the low-pressure side. Fuel delivery pipe 160 and high-pressure fuel pump 150 are connected to a low-pressure fuel pump 180 of an electric motor driven type via a common fuel pressure regulator 170. Further, low-pressure fuel pump 180 is connected to a fuel tank 200 via a fuel filter 190. Fuel pressure regulator 170 is configured to return a part of the fuel discharged from low-pressure fuel pump 180 to fuel tank 200 when the pressure of the fuel discharged from low-pressure fuel pump 180 becomes higher than a preset fuel pressure. This prevents the pressure of the fuel supplied to intake manifold injectors 120 as well as the pressure of the fuel supplied to high-pressure fuel pump 150 from becoming higher than the preset fuel pressure.

Engine ECU 300 is configured with a digital computer, which includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air amount, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to fuel delivery pipe 130, which generates an output voltage proportional to a fuel pressure in fuel delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a stoichiometric air-fuel ratio.

In the present embodiment, engine ECU 300 calculates a feedback correction amount for the total fuel injection amount based on the output voltage of air-fuel ratio sensor 420. In addition, when a predetermined learning condition is satisfied, engine ECU 300 calculates a learn value of the feedback correction amount (a value representing constant deviation with regard to the amount of fuel injection). Calculation of the feedback correction amount and the learn value thereof are performed in a learning region predetermined by using an intake air amount as a parameter. The learning region will be described in detail later.

As to a method of calculating the feedback correction amount and the learn value thereof, a technique commonly used in the internal combustion engine including one injector for each cylinder is used. Therefore, detailed description thereof will not be repeated.

Accelerator pedal 100 is connected to an accelerator position sensor 440 that generates an output voltage proportional to a degree of press-down of accelerator pedal 100. The output voltage of accelerator position sensor 440 is input via an A/D converter 450 to input port 350. An engine speed sensor 460 generating an output pulse representing the engine speed is connected to input port 350. ROM 320 of engine ECU 300 prestores, in the form of a map, values of fuel injection amount that are set corresponding to operation states based on the engine load factor and the engine speed obtained by the above-described accelerator position sensor 440 and engine speed sensor 460, respectively, and the correction values based on the engine coolant temperature.

Figure 2:
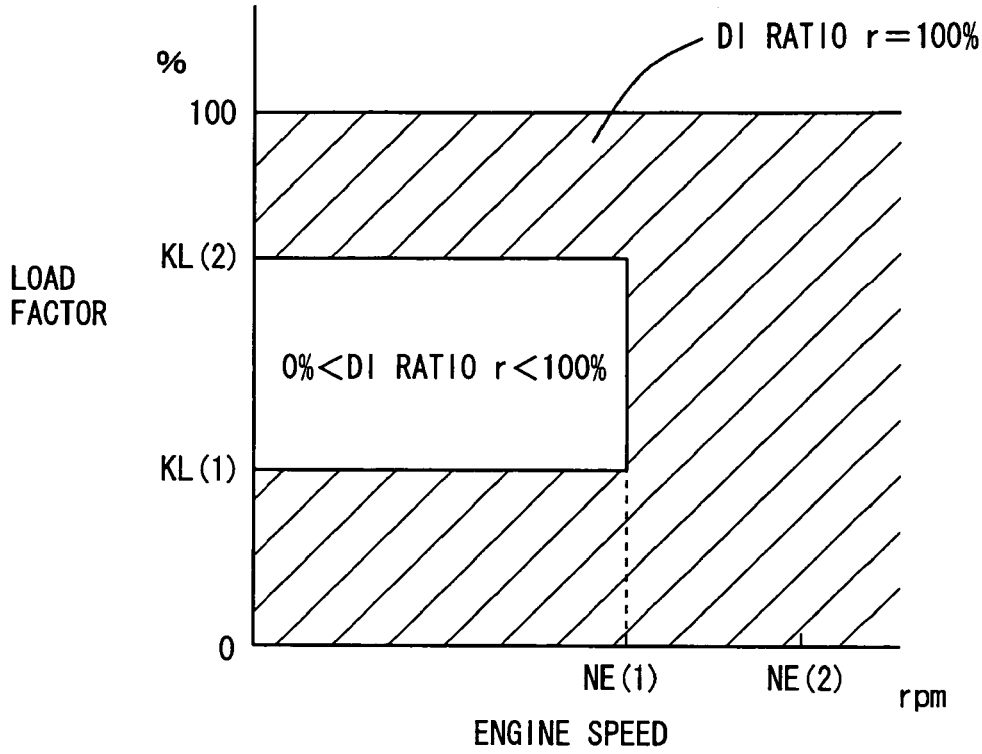
FIGS. 2 and 3 illustrate DI ratio maps in a warm state and a cold state respectively, stored in an engine ECU serving as the control device according to the first embodiment of the present invention.
Figure 3:
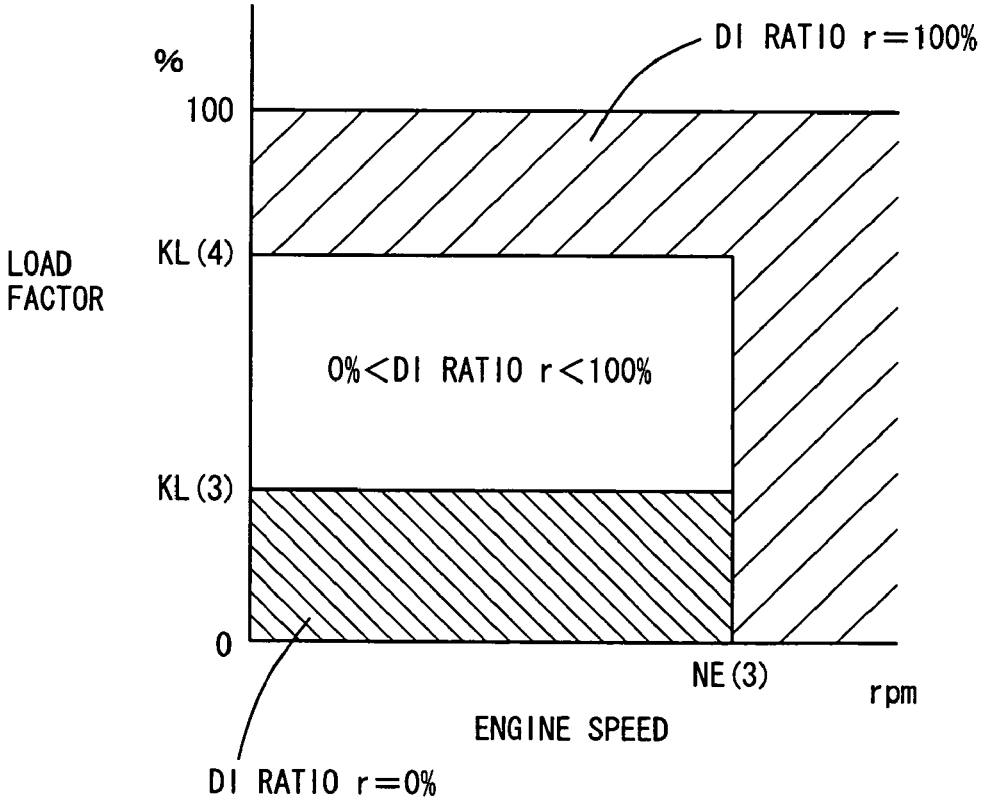

Referring to FIGS. 2 and 3, maps each indicating a fuel injection ratio between in-cylinder injector 110 and intake manifold injector 120 (hereinafter, also referred to as a DI ratio (r)), identified as information associated with an operation state of engine 10, will now be described. The maps are stored in ROM 320 of engine ECU 300. FIG. 2 is the map for a warm state of engine 10, and FIG. 3 is the map for a cold state of engine 10.

In the maps illustrated in FIGS. 2 and 3, with the horizontal axis representing an engine speed of engine 10 and the vertical axis representing a load factor, the fuel injection ratio of in-cylinder injector 110, or the DI ratio r, is expressed in percentage.

As shown in FIGS. 2 and 3, the DI ratio r is set for each operation region that is determined by the engine speed and the load factor of engine 10. "DI RATIO r=100%" represents the region where fuel injection is carried out using only in-cylinder injector 110, and "DI RATIO r=0%" represents the region where fuel injection is carried out using only intake manifold injector 120. "DI RATIO r≠0%", "DI RATIO r≠100%" and "0%<DI RATIO r<100%" each represent the region where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of engine 10 (other than the abnormal operation state such as a catalyst warm-up state during idling).

Further, as shown in FIGS. 2 and 3, the fuel injection ratio between in-cylinder injector 110 and intake manifold injector 120, or the DI ratio r, is defined individually in the map for the warm state and in the map for the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 2 is selected; otherwise, the map for the cold state shown in FIG. 3 is selected. One or both of in-cylinder injector 110 and intake manifold injector 120 are controlled based on the selected map and according to the engine speed and the load factor of engine 10.

In the present embodiment, the amount of fuel injection from in-cylinder injector 110 and the amount of fuel injection from intake manifold injector 120 are determined based on DI ratio r such that the total fuel injection amount attains the desired injection amount.

The engine speed and the load factor of engine 10 set in FIGS. 2 and 3 will now be described. In FIG. 2, NE(1) is set to 2500 rpm to 2700 rpm, KL(1) is set to 30% to 50%, and KL(2) is set to 60% to 90%. In FIG. 3, NE(3) is set to 2900 rpm to 3100 rpm. That is, NE(1)<NE(3). NE(2) in FIG. 2 as well as KL(3) and KL(4) in FIG. 3 are also set as appropriate.

When comparing FIG. 2 and FIG. 3, NE(3) of the map for the cold state shown in FIG. 3 is greater than NE(1) of the map for the warm state shown in FIG. 2. This shows that, as the temperature of engine 10 is lower, the control region of intake manifold injector 120 is expanded to include the region of higher engine speed. That is, in the case where engine 10 is cold, deposits are unlikely to accumulate in the injection hole of in-cylinder injector 110 (even if the fuel is not injected from in-cylinder injector 110). Thus, the region where the fuel injection is to be carried out using intake manifold injector 120 can be expanded, to thereby improve homogeneity.

When comparing FIG. 2 and FIG. 3, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 solely is used in the region of a predetermined high engine speed, and in the region of a predetermined high engine load. That is, in the high speed region or the high load region, even if fuel injection is carried out using only in-cylinder injector 110, the engine speed and the load of engine 10 are high, ensuring a sufficient intake air amount, so that it is readily possible to obtain a homogeneous air-fuel mixture even using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 2, fuel injection is carried out using only in-cylinder injector 110 when the load factor is KL(1) or less. This shows that in-cylinder injector 110 alone is used in a predetermined low load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection amount thereof Thus, in-cylinder injector 110 alone is used in the relevant region.

When comparing FIG. 2 and FIG. 3, there is a region of "DI RATIO r=0%" only in the map for the cold state in FIG. 3. This shows that fuel injection is carried out using only intake manifold injector 120 in a predetermined low load region (KL(3) or less) when the temperature of engine 10 is low. When engine 10 is cold and low in load and the intake air amount is small, atomization of the fuel is unlikely to occur. In such a region, it is difficult to ensure favorable combustion with the fuel injection from in-cylinder injector 110. Further, particularly in the low-load and low-speed region, high output using in-cylinder injector 110 is unnecessary. Accordingly, fuel injection is carried out using only intake manifold injector 120, rather than in-cylinder injector 10, in the relevant region.

Further, in an operation other than the normal operation, or in the catalyst warm-up state during idling of engine 10 (abnormal operation state), in-cylinder injector 110 is controlled to carry out stratified charge combustion. By causing the stratified charge combustion only during the catalyst warm-up operation, warming up of the catalyst is promoted, and exhaust emission is thus improved.

Moreover, in the present embodiment, aside from the map for the cold state shown in FIG. 3, DI ratio r is set to 0% (DI ratio r=0%), that is, the fuel is injected solely from intake manifold injector 120, at the time of cold start of engine 10 (at the time of start when the temperature of the coolant in the internal combustion engine is lower than the predetermined temperature). Therefore, during cranking when the temperature of the coolant in the internal combustion engine is lower than the predetermined temperature, the fuel is injected solely from intake manifold injector 120. In addition, during idling when engine 10 is cold (during idling when the temperature of the coolant of the internal combustion engine is lower than the predetermined temperature), the fuel is injected solely from intake manifold injector 120. It is noted that the fuel may be injected solely from in-cylinder injector 10, instead of intake manifold injector 120.

Figure 4:
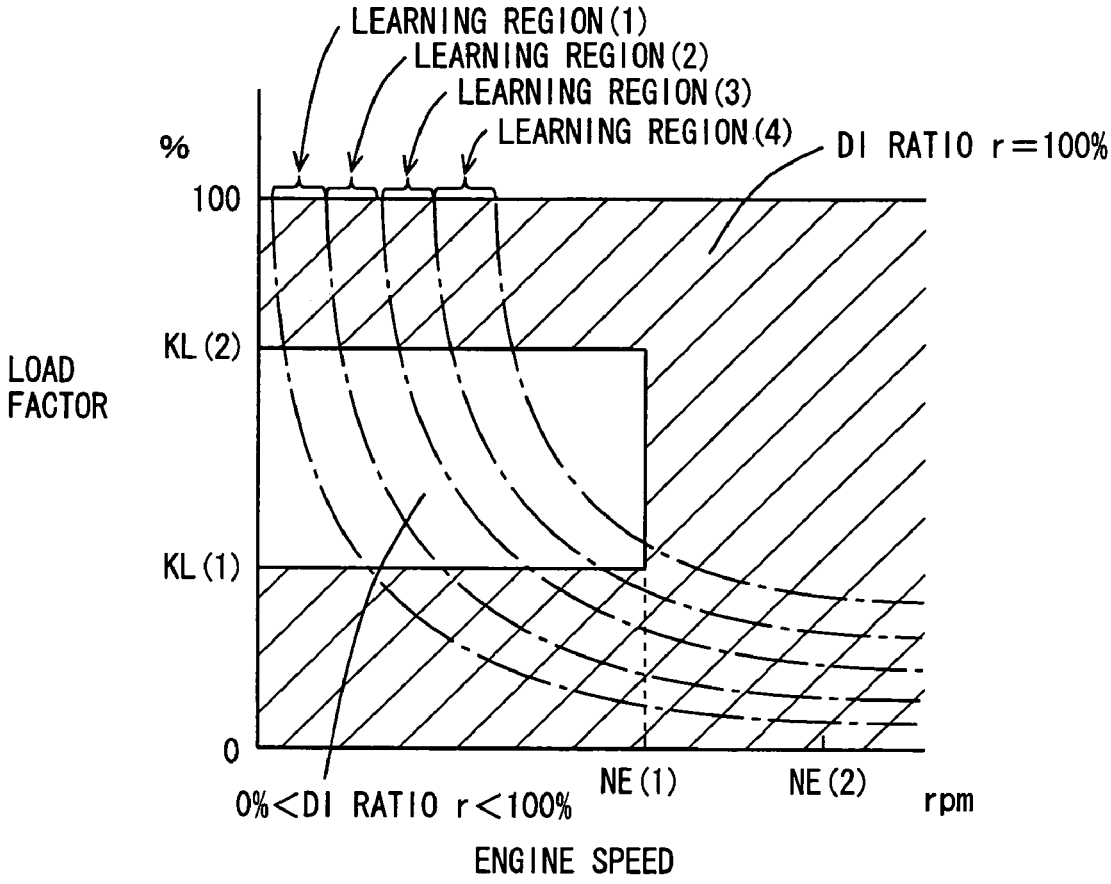
FIG. 4 is a first diagram showing a learning region of an amount of fuel injection stored in the engine ECU serving as the control device according to the first embodiment of the present invention.

A learning region where a feedback correction amount and a learn value thereof are calculated will now be described with reference to FIGS. 4 and 5. FIG. 4 shows a learning region in the map for the warm state, while FIG. 5 shows a learning region in the map for the cold state.

Figure 5:
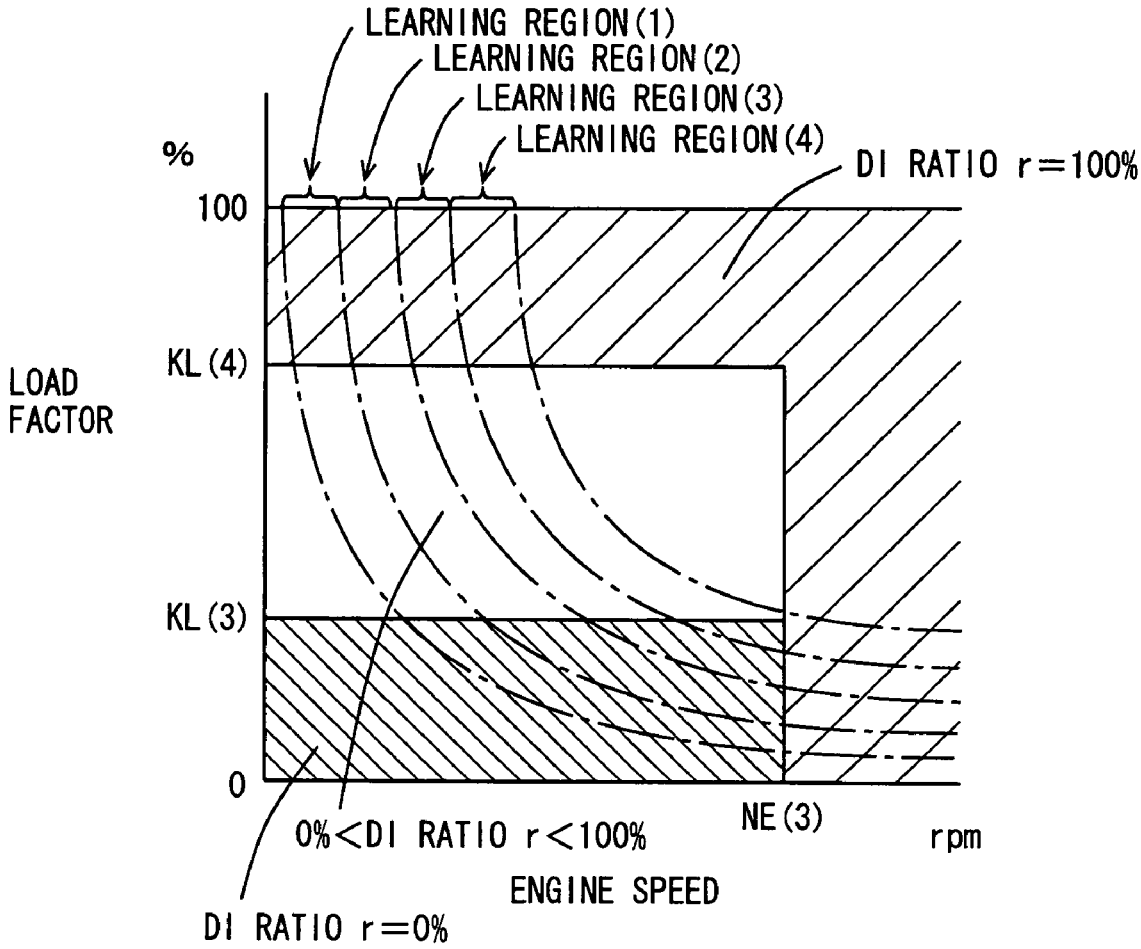
FIG. 5 is a second diagram showing a learning region of an amount of fuel injection stored in the engine ECU serving as the control device according to the first embodiment of the present invention.

In FIGS. 4 and 5, regions adjacent to each other delimited by chain dotted curves represent the learning regions. The learning region is divided in accordance with an intake air amount. The learning region is set in accordance with the intake air amount because error in output of airflow meter 42 is different depending on the intake air amount.

In the present embodiment, four learning regions, i.e., learning regions (1) to (4), are provided. The intake air amount is largest in learning region (1), second largest in learning region (2), then learning region (3), and smallest in learning region (4). It is noted that the number of learning regions is not limited to four.

In the present embodiment, the feedback correction amount and the learn value thereof are calculated not only for each learning region but also for each injection region (a region where DI ratio r=100%, a region where 0%<DI ratio r<100%, and a region where DI ratio r=0%). In other words, the feedback correction amount and the learn value thereof are calculated for each learning region in each injection region.

Figure 6:
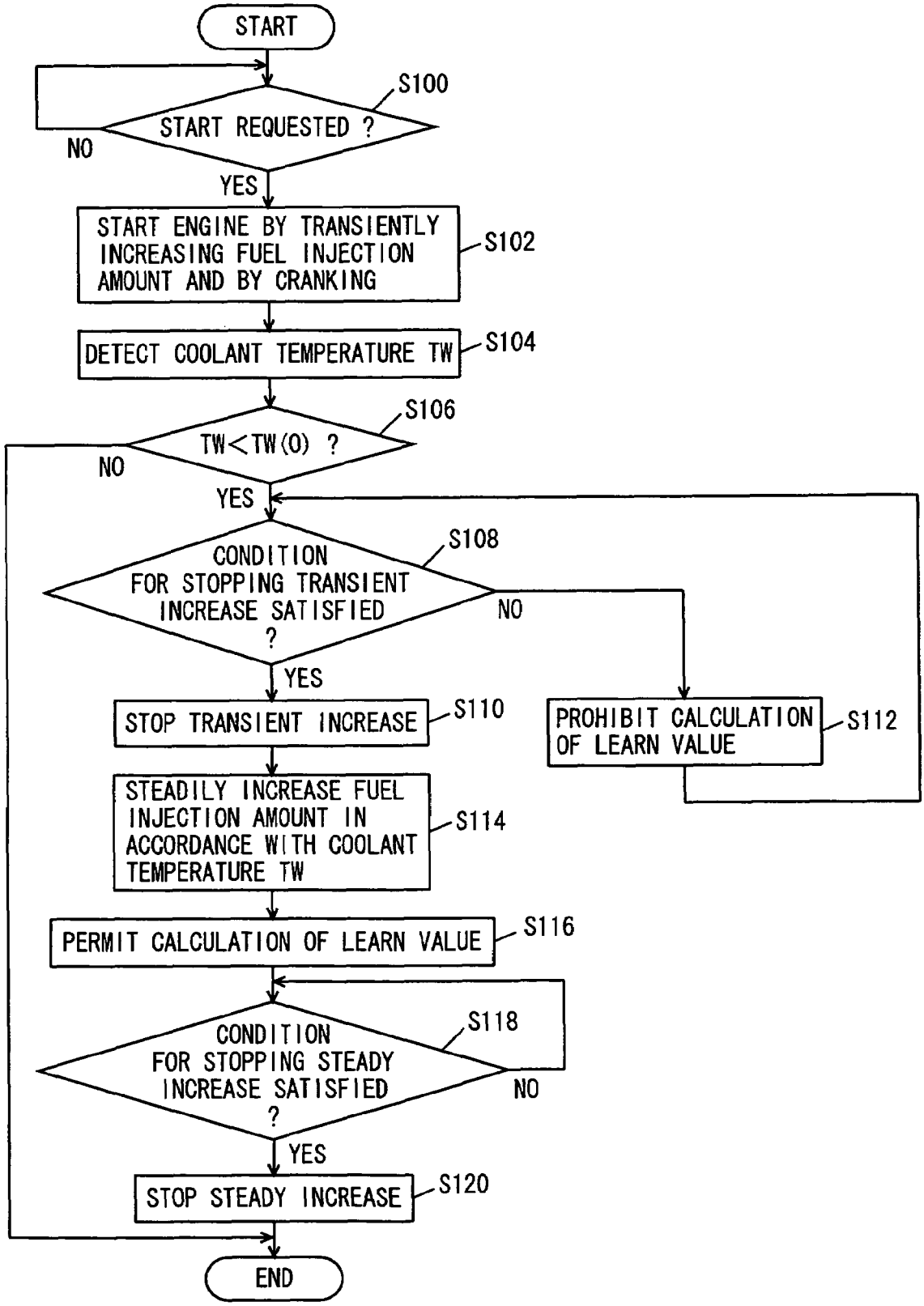
FIG. 6 is a flowchart showing a control configuration of a program executed in the engine ECU serving as the control device according to the first embodiment of the present invention.

A control configuration of a program executed in engine ECU 300 serving as the control device for the internal combustion engine according to the present embodiment will be described with reference to FIG. 6.

At step (hereinafter, step is abbreviated as S) 100, engine ECU 300 determines whether or not a request for starting engine 10 has been detected. For example, when an operation to turn on a start switch has been performed or when an ignition key has been turned to a start position, it is determined that the request for starting engine 10 has been detected. When the request for start has been detected (YES at S100), the process proceeds to S102. Otherwise (NO at S100), the process returns to S100. At S102, engine ECU 300 starts engine 10 by transiently increasing the amount of fuel injection and by cranking engine 10.

At S104, engine ECU 300 detects a coolant temperature TW of engine 10 based on a signal transmitted from coolant temperature sensor 380. At S106, engine ECU 300 determines whether or not coolant temperature TW is lower than a threshold value TW(0). When coolant temperature TW is lower than threshold value TW(0) (YES at S106), the process proceeds to S108. Otherwise (NO at S106), the process ends.

At S108, engine ECU 300 determines whether or not a condition for stopping transient increase in the amount of fuel injection is satisfied. Here, the condition for stopping transient increase refers to such a condition that engine 10 attains full combustion (the engine speed of engine 10 is higher than a predetermined engine speed). It is noted that the condition for stopping transient increase is not limited as such.

When the condition for stopping transient increase is satisfied (YES at S108), the process proceeds to S110. Otherwise (NO at S108), the process proceeds to S112. At S110, engine ECU 300 stops transient increase in the amount of fuel injection. At S112, engine ECU 300 prohibits calculation (update) of the learn value.

At S114, engine ECU 300 steadily increases the amount of fuel injection in accordance with coolant temperature TW. For example, as coolant temperature TW is lower, the amount of fuel injection is increased. At S116, engine ECU 300 permits calculation (update) of the learn value.

At S118, engine ECU 300 determines whether or not a condition for stopping steady increase in the amount of fuel injection is satisfied. Here, the condition for stopping steady increase refers to such a condition that the temperature of engine 10, that is, coolant temperature TW, is higher than the predetermined temperature. It is noted that the condition for stopping steady increase is not limited as such, and the condition may be such that a predetermined time period has elapsed since stop of transient increase or the accumulated engine speed after the stop of transient increase exceeds a predetermined engine speed. When the condition for stopping steady increase is satisfied (YES at S118), the process proceeds to S120. Otherwise (NO at S118), the process returns to S118.

At S120, engine ECU 300 stops steady increase in the amount of fuel injection. Thereafter, the process ends.

An operation of engine ECU 300 serving as the control device for the internal combustion engine according to the present embodiment based on the configuration and the flowchart above will now be described.

Figure 7:
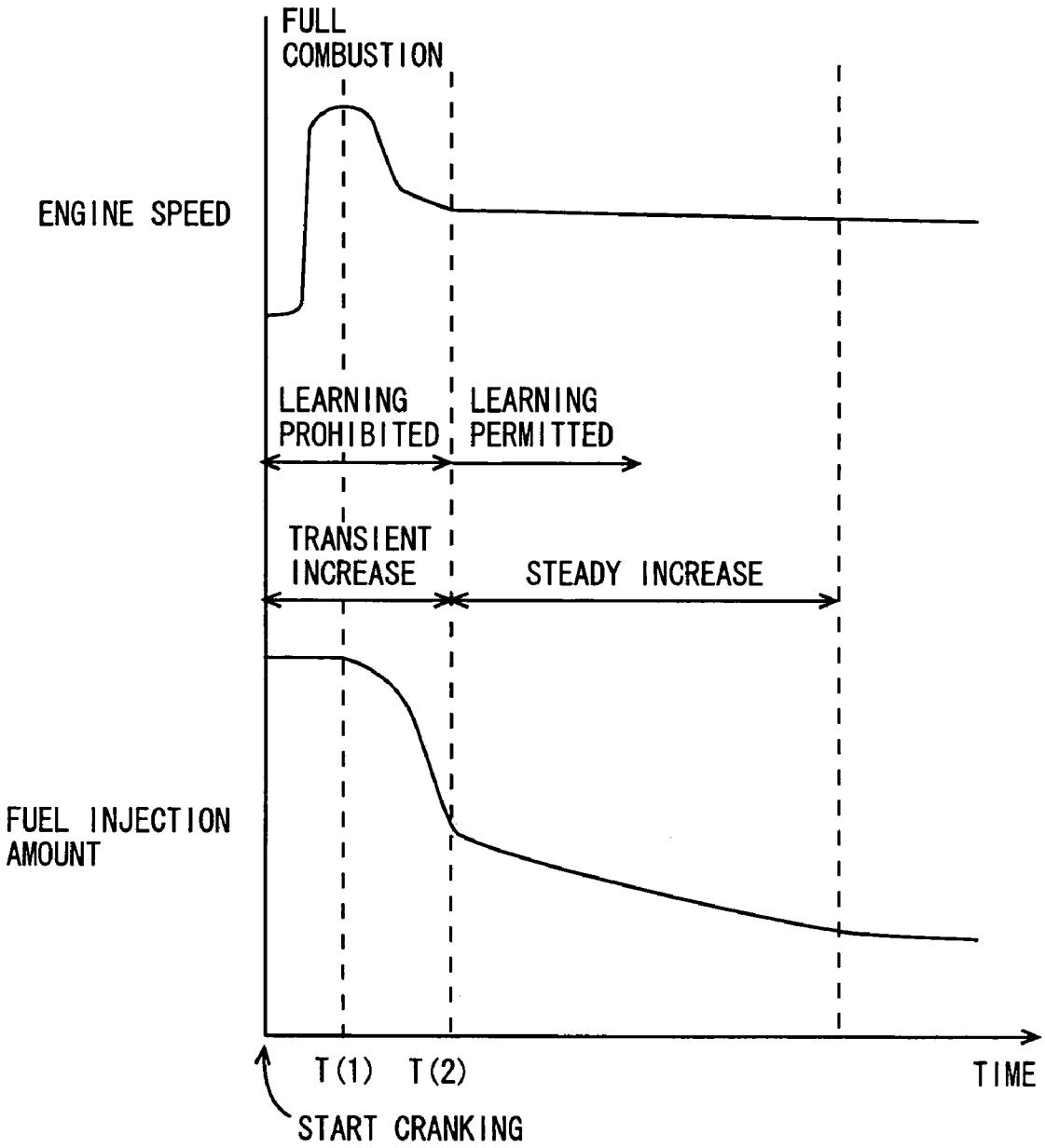
FIG. 7 is a timing chart showing transition of the amount of fuel injection.

When the request for start is detected from a non-operating state of engine 10 (YES at S100), in order to improve starting capability, the amount of fuel injection is transiently increased and cranking of engine 10 is started as shown in FIG. 7, whereby engine 10 is started (S102).

During this state, the air-fuel ratio is unstable and may suddenly change. Therefore, if a learn value is calculated during transient increase, miscalculation of the learn value and hence unnecessary correction of the amount of fuel injection is likely.

As there is an occasion to calculate a learn value in the region where DI ratio r=100% and in the region where 0%<DI ratio r<100% after warm-up of engine 10, influence by erroneous learning is slight. On the other hand, as it is solely during the cold state that a learn value in the region where DI ratio r=0% is calculated, the learn value should be calculated with higher accuracy.

Therefore, when the engine is started, coolant temperature TW is detected (S104) and whether or not coolant temperature TW is lower than threshold value TW(0) is determined (S106). If coolant temperature TW is lower than threshold value TW(0) (YES at S106), that is, during the cold state of engine 10, whether or not the condition for stopping transient increase in the amount of fuel injection has been satisfied is determined (S108).

If the condition for stopping transient increase in the amount of fuel injection has not been satisfied (NO at S108), that is, if transient increase in the amount of fuel injection continues, calculation of the learn value is prohibited (S112). Unnecessary correction of the amount of fuel injection caused by calculation of the learn value in such a state that the air-fuel ratio may suddenly change can thus be suppressed.

On the other hand, when the condition for stopping transient increase in the amount of fuel injection has been satisfied (YES at S108), that is, when engine 10 attains full combustion, transient increase in the amount of fuel injection is stopped (S110). Here, it is assumed as shown in FIG. 7 that, after engine 10 attains full combustion at time T(1), the amount of fuel injection is gradually decreased and transient increase in the amount of fuel injection is stopped at time T(2).

Even after transient increase is stopped, it is difficult to atomize the fuel during the cold state, and the engine speed of engine 10 may not be maintained at the desired engine speed with a normal amount of fuel injection (the same as the amount of fuel injection during the warm state). Therefore, the amount of fuel injection is steadily increased in accordance with coolant temperature TW (S114). The operation state of engine 10 during this period includes idling.

When the amount of fuel injection is steadily increased, it can be said that the air-fuel ratio is stable. Therefore, when a learn value is calculated during this period, miscalculation is less likely. Meanwhile, an occasion to calculate the learn value in the region where DI ratio r=0%, that is, the learn value when the fuel is injected solely from intake manifold injector 120, is limited to those during the cold state. Therefore, it is necessary to ensure as many occasions as possible to calculate the learn value also during the cold state, as well as to accurately calculate the learn value in the region where DI ratio r=0%.

Figure 8:
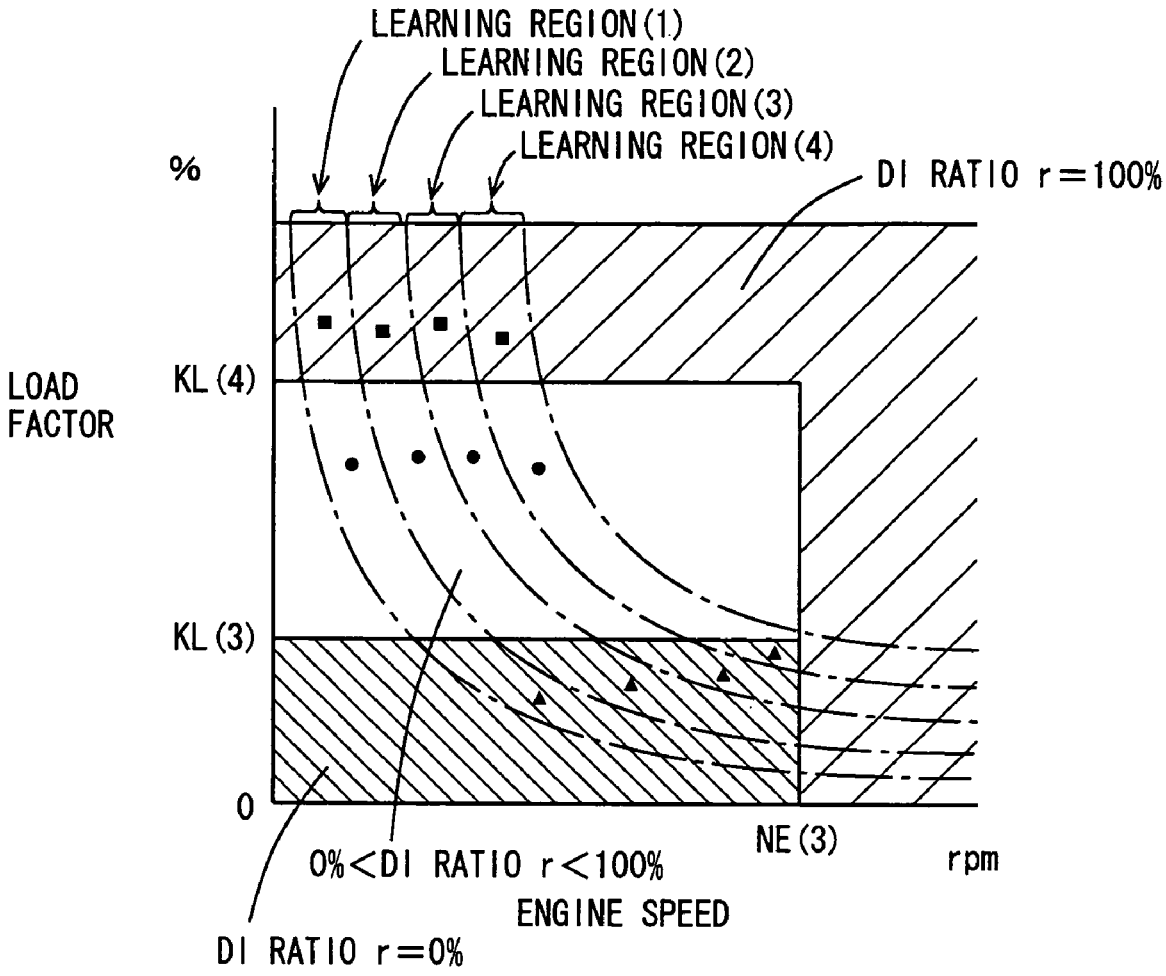
FIG. 8 shows a state in which a learn value has been calculated for each learning region, in each injection region.

Therefore, while the amount of fuel injection is steadily increased in accordance with coolant temperature TW, calculation of the learn value is permitted (S116). Thus, the learn value is calculated while the air-fuel ratio is stable, and the learn value can be obtained for each learning region in each injection region (particularly in the region where DI ratio r=0%), as shown in FIG. 8. Though not shown, the learn value when DI ratio r=0% during idling can be obtained.

FIG. 8 shows a state in which one learn value has been calculated for each learning region in each injection region. In FIG. 8, squares indicate learn values in the region where DI ratio r=100%, circles indicate learn values in the region where 0%<DI ratio r<100%, and triangles indicate learn values in the region where DI ratio r=0%.

Thereafter, when the condition for stopping steady increase in the amount of fuel injection is satisfied (YES at S118), that is, when the condition that coolant temperature TW is higher than the predetermined temperature is satisfied, steady increase in the amount of fuel injection is stopped (S120).

As described above, according to the engine ECU serving as the control device for the internal combustion engine according to the present embodiment, while the engine is in the cold state and when the amount of fuel injection is transiently increased at the time of start of engine, calculation of the learn value is prohibited. While the amount of fuel injection is steadily increased in accordance with coolant temperature TW after transient increase is stopped, calculation of the learn value is permitted. In this manner, erroneous learning of the learn value while the air-fuel ratio may suddenly change can be suppressed and the learn value can accurately be calculated. Therefore, unnecessary correction of the amount of fuel injection can be suppressed. Consequently, the air-fuel ratio can be controlled to be appropriate and exhaust emission performance can be improved.

When the amount of fuel injection is transiently corrected, for example, based on the fuel adhered to the wall surface of the intake port or the fuel purged from the canister (not shown), the air-fuel ratio becomes unstable. Accordingly, the learn value calculated during such correction while the amount of fuel injection is steadily increased in accordance with coolant temperature TW may not be stored in RAM 330 so as to prohibit correction of the amount of fuel injection based on that learn value.

Second Embodiment

Figure 9:
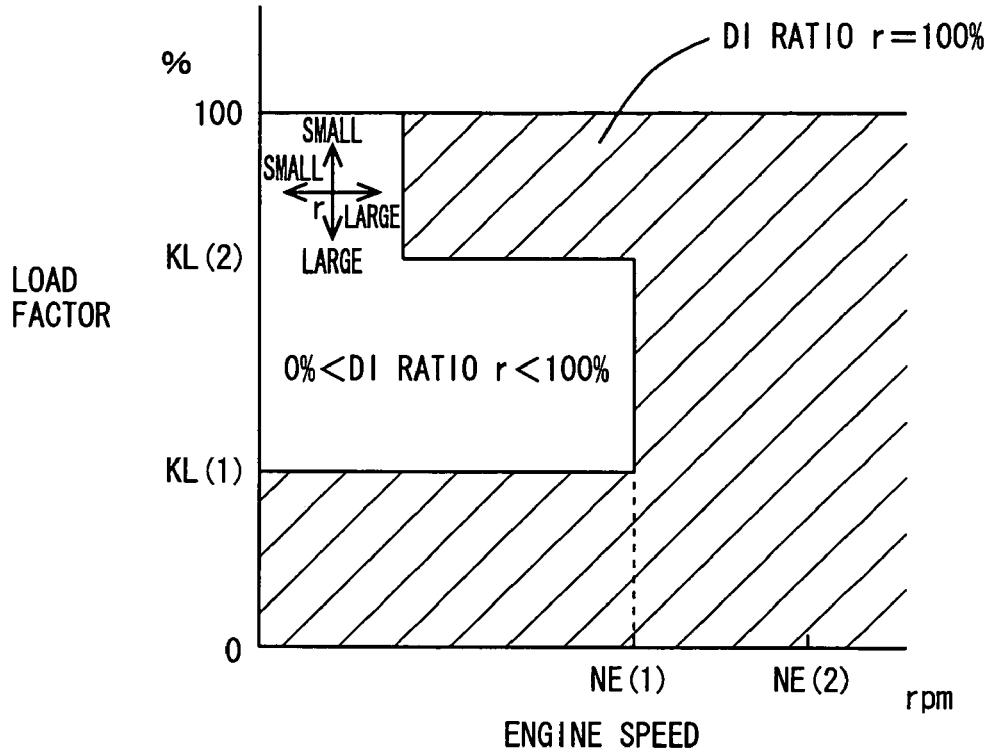
FIGS. 9 and 10 illustrate DI ratio maps in a warm state and a cold state respectively, stored in an engine ECU serving as a control device according to a second embodiment of the present invention.
Figure 10:
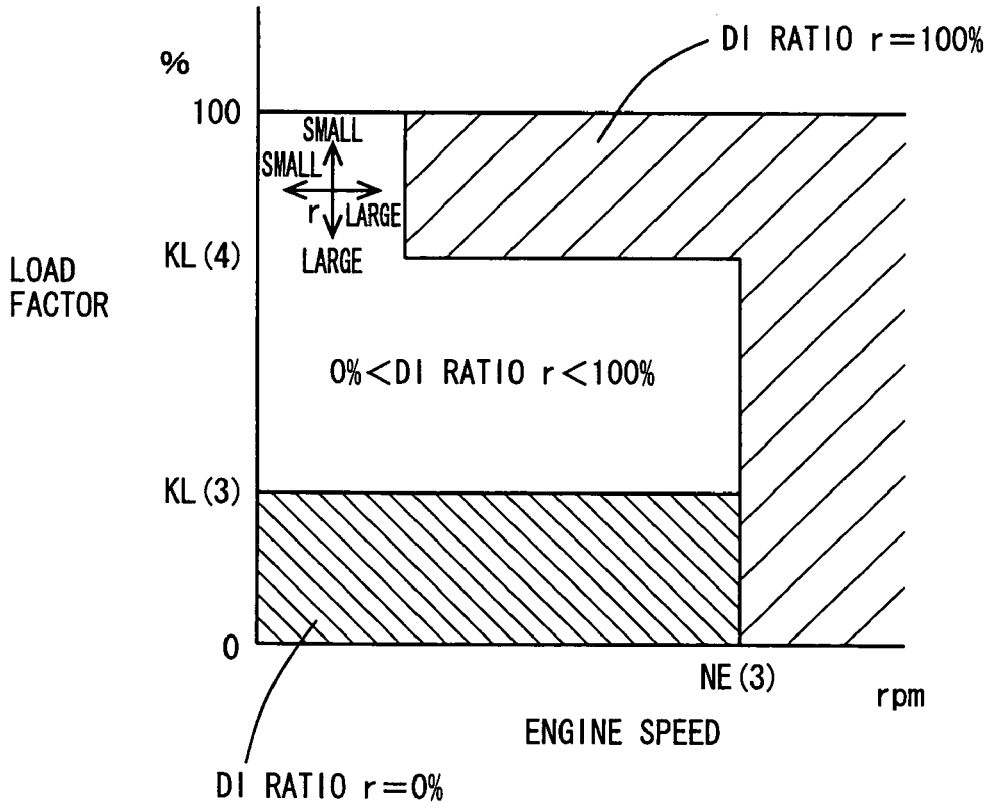

Referring to FIGS. 9 and 10, a second embodiment of the present invention will be described. In the present embodiment, DI ratio r is calculated using a map different from those in the first embodiment described previously.

As the configuration and the process flow as well as functions thereof are otherwise the same as those in the first embodiment described previously, detailed description thereof will not be repeated.

Referring to FIGS. 9 and 10, maps each indicating the fuel injection ratio between in-cylinder injector 110 and intake manifold injector 120, identified as information associated with the operation state of engine 10, will be described. The maps are stored in ROM 320 of engine ECU 300. FIG. 9 is the map for the warm state of engine 10, and FIG. 10 is the map for the cold state of engine 10.

FIGS. 9 and 10 differ from FIGS. 2 and 3 in the following points. "DI RATIO r=100%" holds in the region where the engine speed of engine 10 is equal to or higher than NE(1) in the map for the warm state, and in the region where engine 10 speed is NE(3) or higher in the map for the cold state. Further, except for the low-speed region, "DI RATIO r=100%" holds in the region where the load factor is KL(2) or greater in the map for the warm state, and in the region where the load factor is KL(4) or greater in the map for the cold state. This means that fuel injection is carried out using only in-cylinder injector 110 in the region where the engine speed is at a predetermined high level, and that fuel injection is often carried out using only in-cylinder injector 110 in the region where the engine load is at a predetermined high level. However, in the low-speed and high-load region, mixing of an air-fuel mixture formed by the fuel injected from in-cylinder injector 110 is poor, and such inhomogeneous air-fuel mixture within the combustion chamber may lead to unstable combustion. Thus, the fuel injection ratio of the in-cylinder injector is increased as the engine speed increases where such a problem is unlikely to occur, whereas the fuel injection ratio of in-cylinder injector 110 is decreased as the engine load increases where such a problem is likely to occur. These changes in the DI ratio r are shown by crisscross arrows in FIGS. 9 and 10. In this manner, variation in output torque of the engine attributable to the unstable combustion can be suppressed. It is noted that these measures are approximately equivalent to the measures to decrease the fuel injection ratio of in-cylinder injector 110 as the state of engine 10 moves toward the predetermined low speed region, or to increase the fuel injection ratio of in-cylinder injector 10 as engine 10 state moves toward the predetermined low load region. Further, except for the relevant region (indicated by the crisscross arrows in FIGS. 9 and 10), in the region where fuel injection is carried out using only in-cylinder injector 10 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression end, and thus, the antiknock performance improves. Further, with the temperature of the combustion chamber decreased, intake efficiency improves, leading to high power output.

In engine 10 explained in the first and second embodiments, homogeneous combustion is achieved by setting the fuel injection timing of in-cylinder injector 10 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 10 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to reach the catalyst. Further, a certain amount of fuel needs to be supplied. If the stratified charge combustion is employed to satisfy these requirements, the amount of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in the first and second embodiments, the fuel injection timing of in-cylinder injector 110 is preferably set in the intake stroke in a basic region corresponding to the almost entire region (here, the basic region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the sprayed fuel, so that the combustion rate increases. The improvement in antiknock performance and the increase in combustion rate can prevent variation in combustion, and thus, combustion stability is improved.

Regardless of the temperature of engine 10 (that is, whether engine 10 is in the warm state or in the cold state), the warm state map shown in FIG. 2 or 9 may be used during idle-off state (when an idle switch is off, or when the accelerator pedal is pressed) (regardless of whether engine 10 is in the cold state or in the warm state, in the low load region, in-cylinder injector 110 is used).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device for an internal combustion engine, said internal combustion engine including a first fuel injection mechanism injecting fuel into a cylinder and a second fuel injection mechanism injecting fuel into an intake manifold, comprising:

a first control unit controlling said fuel injection mechanisms so that the fuel is injected solely from any one of said first fuel injection mechanism and said second fuel injection mechanism at least during cranking and idling in which a temperature of said internal combustion engine is equal to or lower than a predetermined value;

a second control unit controlling said fuel injection mechanisms so that the fuel is injected from said first fuel injection mechanism and said second fuel injection mechanism;

a first calculation unit calculating a feedback correction amount for an amount of fuel injection based on an air-fuel ratio;

a second calculation unit calculating a learn value of the feedback correction amount when a predetermined condition is satisfied;

a prohibition unit prohibiting calculation of the learn value at least during a period from start of cranking of said internal combustion engine to full combustion thereof; and a permission unit permitting calculation of the learn value during a predetermined period after full combustion of said internal combustion engine.

2. The control device for an internal combustion engine according to claim 1, wherein said first control unit controls said fuel injection mechanism so that the fuel is injected solely from said second fuel injection mechanism during cranking and idling in which the temperature of said internal combustion engine is equal to or lower than the predetermined value.

3. The control device for an internal combustion engine according to claim 1, wherein said predetermined period is a period during which the amount of fuel injection is corrected based on the temperature of said internal combustion engine.

4. The control device for an internal combustion engine according to claim 3, further comprising a correction prohibition unit prohibiting correction of the amount of fuel injection based on the correction value calculated when the amount of fuel injection is corrected based on a factor other than the temperature and the air-fuel ratio of said internal combustion engine.

5. The control device for an internal combustion engine according to claim 1, wherein said first fuel injection mechanism is an in-cylinder injector, and said second fuel injection mechanism is an intake manifold injector.

6. The control device for an internal combustion engine according to claim 2, wherein said first fuel injection mechanism is an in-cylinder injector, and said second fuel injection mechanism is an intake manifold injector.

7. The control device for an internal combustion engine according to claim 3, wherein said first fuel injection mechanism is an in-cylinder injector, and said second fuel injection mechanism is an intake manifold injector.

8. The control device for an internal combustion engine according to claim 4, wherein said first fuel injection mechanism is an in-cylinder injector, and said second fuel injection mechanism is an intake manifold injector.

9. A control device for an internal combustion engine, said internal combustion engine including first fuel injection means injecting fuel into a cylinder and second fuel injection means injecting fuel into an intake manifold, comprising:

first control means for controlling said fuel injection means so that the fuel is injected solely from any one of said first fuel injection means and said second fuel injection means at least during cranking and idling in which a temperature of said internal combustion engine is equal to or lower than a predetermined value;

second control means for controlling said fuel injection means so that the fuel is injected from said first fuel injection means and said second fuel injection means;

first calculation means for calculating a feedback correction amount for an amount of fuel injection based on an air-fuel ratio;

second calculation means for calculating a learn value of the feedback correction amount when a predetermined condition is satisfied;

prohibition means for prohibiting calculation of the learn value at least during a period from start of cranking of said internal combustion engine to full combustion thereof; and permission means for permitting calculation of the learn value during a predetermined period after full combustion of said internal combustion engine.

10. The control device for an internal combustion engine according to claim 9, wherein said first control means includes means for controlling said fuel injection means so that the fuel is injected solely from said second fuel injection means during cranking and idling in which the temperature of said internal combustion engine is equal to or lower than the predetermined value.

11. The control device for an internal combustion engine according to claim 9, wherein said predetermined period is a period during which the amount of fuel injection is corrected based on the temperature of said internal combustion engine.

12. The control device for an internal combustion engine according to claim 11, further comprising means for prohibiting correction of the amount of fuel injection based on the correction value calculated when the amount of fuel injection is corrected based on a factor other than the temperature and the air-fuel ratio of said internal combustion engine.

13. The control device for an internal combustion engine according to claim 9, wherein said first fuel injection means is an in-cylinder injector, and said second fuel injection means is an intake manifold injector.

14. The control device for an internal combustion engine according to claim 10, wherein said first fuel injection means is an in-cylinder injector, and said second fuel injection means is an intake manifold injector.

15. The control device for an internal combustion engine according to claim 11, wherein said first fuel injection means is an in-cylinder injector, and said second fuel injection means is an intake manifold injector.

16. The control device for an internal combustion engine according to claim 12, wherein said first fuel injection means is an in-cylinder injector, and said second fuel injection means is an intake manifold injector.

* * * * *